US007780376B2

(12) United States Patent
Bracken et al.

(10) Patent No.: US 7,780,376 B2
(45) Date of Patent: Aug. 24, 2010

(54) INTERIOR UNDERPIN BRACKET AND SYSTEM AND METHOD FOR ELEVATING A STRUCTURE

(75) Inventors: William Bracken, Lutz, FL (US); Jose Busquets, Lutz, FL (US)

(73) Assignee: Bracken Engineering, Inc., Tampa, FL (US)

( * ) Notice: Subject to any disclaimer, the term of this patent is extended or adjusted under 35 U.S.C. 154(b) by 100 days.

(21) Appl. No.: 11/962,200

(22) Filed: Dec. 21, 2007

(65) Prior Publication Data

US 2008/0152434 A1 Jun. 26, 2008

Related U.S. Application Data

(60) Provisional application No. 60/876,285, filed on Dec. 21, 2006.

(51) Int. Cl.
*E02D 35/00* (2006.01)
*E02D 27/48* (2006.01)

(52) U.S. Cl. ..... 405/230; 405/229; 405/232; 52/125.1

(58) Field of Classification Search ..... 405/229–232; 52/125.1, 126.5, 126.6, 293.1, 293.5; 248/351, 248/346.3, 188.6
See application file for complete search history.

(56) References Cited

U.S. PATENT DOCUMENTS 3,431,012 A 3/1969 Courtois et al.
4,017,115 A 4/1977 Holt et al.
4,035,969 A * 7/1977 Casagrande ..... 52/111
4,338,715 A 7/1982 Capers
4,800,700 A 1/1989 May
4,843,785 A 7/1989 Sero et al.
4,882,891 A 11/1989 Sero et al.
4,974,997 A 12/1990 Sero et al.
5,123,209 A 6/1992 Nally
5,205,673 A 4/1993 Bolin et al.
5,269,630 A 12/1993 Bolin et al.
5,482,407 A 1/1996 Raaf
6,676,335 B1 1/2004 Hickman
6,814,524 B1 * 11/2004 Peterson ..... 405/230
7,163,357 B1 1/2007 Peterson
2005/0220544 A1 * 10/2005 Bisson et al. ..... 405/230

* cited by examiner

*Primary Examiner*—David J Bagnell
*Assistant Examiner*—Benjamin Fiorello
(74) *Attorney, Agent, or Firm*—Sentry Law Group

(57) ABSTRACT

Various embodiments of subsurface support devices, interior underpin brackets, and systems and methods for elevating a settled or settling structure are disclosed. One embodiment comprises an interior underpin bracket. One such bracket comprises: a support shaft having a bore adapted to receive an underpin pipe; and at least two support arms pivotally fixed to the support shaft, the support arms adjustable between a retracted position in which the support arms are disposed parallel to the support shaft and an extended position in which the support arms are disposed perpendicular to the support shaft.

18 Claims, 8 Drawing Sheets

INTERIOR UNDERPIN BRACKET AND SYSTEM AND METHOD FOR ELEVATING A STRUCTURE

CROSS-REFERENCE TO RELATED APPLICATION

This application claims the benefit of the priority of U.S. Provisional Patent Application Ser. No. 60/876,285, entitled "Interior Underpin Bracket", and filed Dec. 21, 2006, which is hereby incorporated by reference in its entirety.

BACKGROUND

A common problem in the field of structural engineering involves the settling of erected structures (e.g., foundations, buildings or components of buildings). It is known that structures erected on ground may be subject to a number of unstability conditions that may damage or weaken load bearing elements. For example, the soil underneath a structure may become unstable and cause the structure to become uneven relative to the original position of the structure. This settling may cause structural damage to the foundation of the structure and/or the erected structure. There are a number of existing solutions for remedying the settling problem.

Most solutions involve underpinning the structure by driving piers into the ground adjacent to the structure and attaching the structure to the piers after the structure has been elevated to a desired position by a hydraulic mechanism. There are a number of disadvantages to these underpinning solutions. The driving piers are only installed around the periphery of the structure. Therefore, a relatively large number of driving piers may be required to distribute the load of the structure, which increases the cost of the underpinning solution. Even with a large number of driving piers adjacent the structure, the lack of sufficient interior support may be problematic under heavy load conditions.

Despite the existence of numerous solutions to the settling problem, there is a need for improved devices, systems, and methods for elevating a settled structure.

SUMMARY

Various embodiments of subsurface support devices, interior underpin brackets, and systems and methods for elevating a settled or settling structure are disclosed. One embodiment comprises an interior underpin bracket. One such bracket comprises: a support shaft having a bore adapted to receive an underpin pipe; and at least two support arms pivotally fixed to the support shaft, the support arms adjustable between a retracted position in which the support arms are disposed parallel to the support shaft and an extended position in which the support arms are disposed perpendicular to the support shaft.

Another embodiment comprises a subsurface support apparatus for elevating a structure. One such apparatus comprises: a support shaft having a first open end, a second open end, and a bore for receiving an underpin pipe; at least two retractable support arms pivotally fixed to the support shaft near the first open end; and an adjustable collar disposed on the support shaft between the retractable support arms and the second open end and pivotally attached to the retractable support arms, the adjustable collar being adjustable on the support shaft to pivot the support arms between a retracted position and an extended position Yet another embodiment comprises a method for elevating a cast-in-place slab. One such method comprises: drilling a hole in a cast-in-place slab; installing an underpin pipe in a subsurface material underneath the cast-in-place slab; removing the subsurface material around the hole; installing a bracket having retractable support arms on the underpin pipe with the retractable support arms in a retracted position; and extending the retractable support arms.

BRIEF DESCRIPTION OF THE DRAWINGS

FIG. 5 is a cross-sectional side view of a cast-in-place slab.

FIG. 6 illustrates the cast-in-place slab of FIG. 5 with a drilled hole and an underpin pile installed.

FIG. 7 illustrates the cast-in-place slab of FIG. 6 with soil around the drilled hole removed prior to installation of the interior underpin bracket.

FIG. 8 illustrates the interior underpin bracket installed over the underpin pile in a retracted position.

FIG. 9 illustrates the interior underpin bracket in an extended position underneath the cast-in-place slab.

DETAILED DESCRIPTION

Various embodiments of subsurface support devices and systems and methods for elevating a settled or settling structure are disclosed. It should be appreciated that the disclosed devices, systems, and methods may be used to elevate any suitable structure, including, but not limited to a foundation, a structure, a portion of a foundation or structure, or a slab, such as, for example, a cast-in-place slab. The structure may comprise any type of material, and may be any size, dimension, or configuration.

In one exemplary embodiment, a subsurface support device comprises an interior underpin bracket for elevating a cast-in-place slab. As described in more detail below with reference to FIGS. 1-9, the interior underpin bracket generally comprises a plurality of retractable support arms, and is designed to provide subsurface support underneath the interior of the structure. The cast-in-place slab may be prepared by drilling a plurality of holes in a suitable grid formation. It should be appreciated that the spacing of the drill holes may be based on, for example, the characteristics of the structure and the settling or unstability conditions of the structure. In one embodiment, the drill holes are made on approximately a 9 foot to 10 foot grid. The size of the drill holes may correspond to the lateral dimensions of the interior underpin bracket in the retracted position. In this manner, the size of the drill holes may be minimized because the interior underpin bracket may be inserted through the drill hole with the retractable support arms in a retracted position. When the interior underpin bracket is positioned underneath the cast-in-place slab (as described below in more detail), the support arms may be extended to a position parallel to the underside of the cast-in-place slab.

Figure 1:
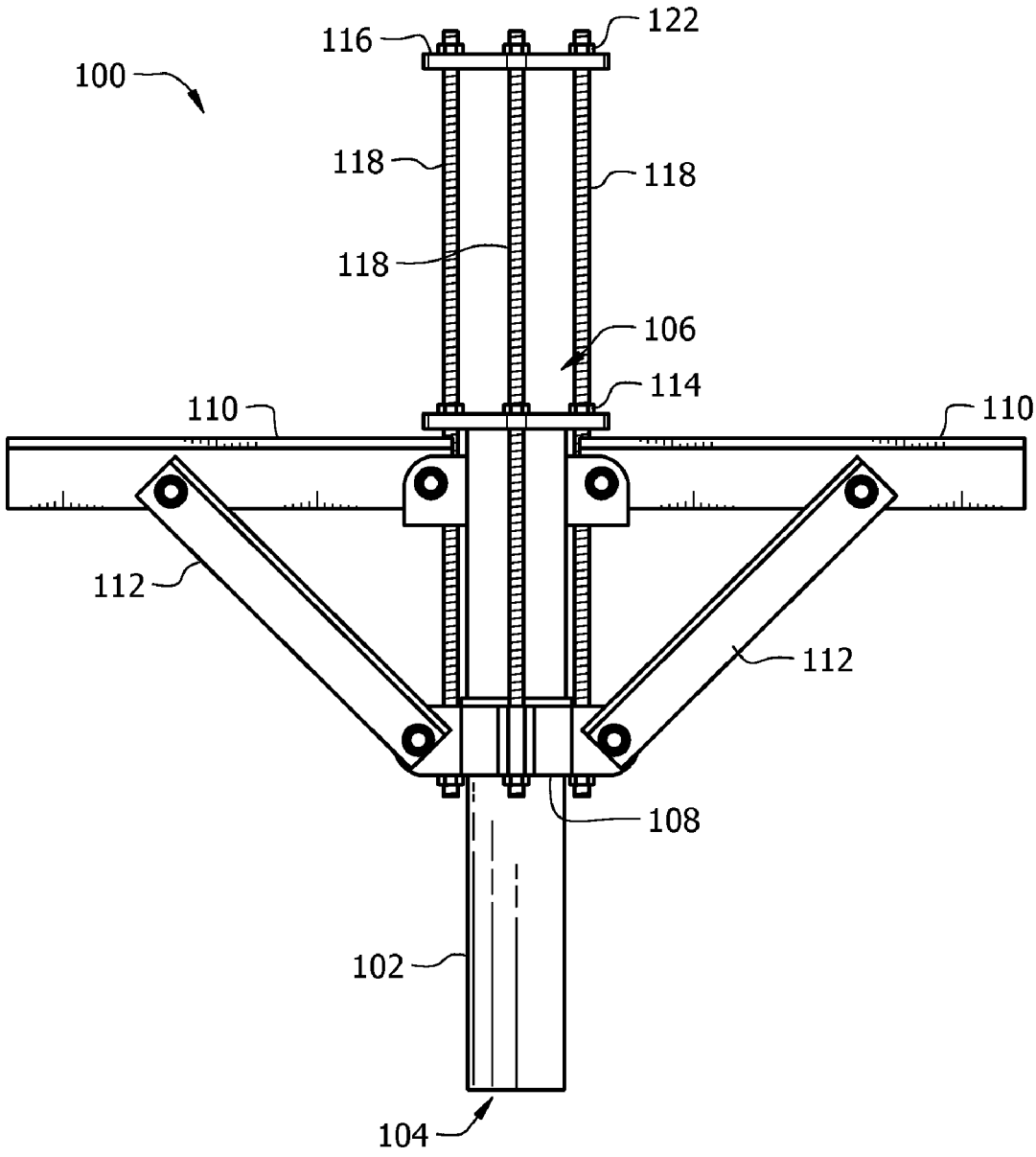
FIG. 1 is a side view of an embodiment of an interior underpin bracket in an extended position.
Figure 2:
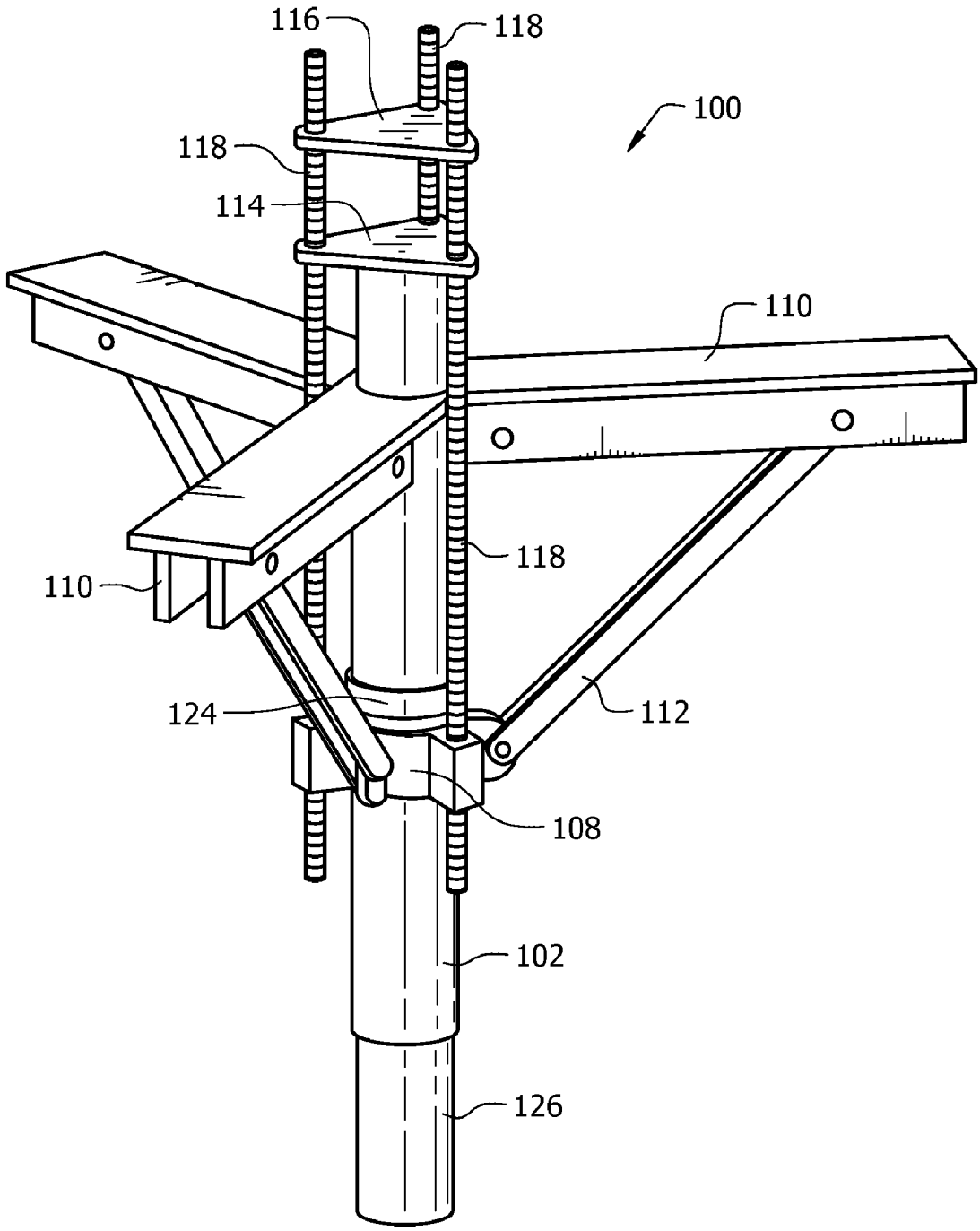
FIG. 2 is a perspective view of the interior underpin bracket of FIG. 1.
Figure 3:
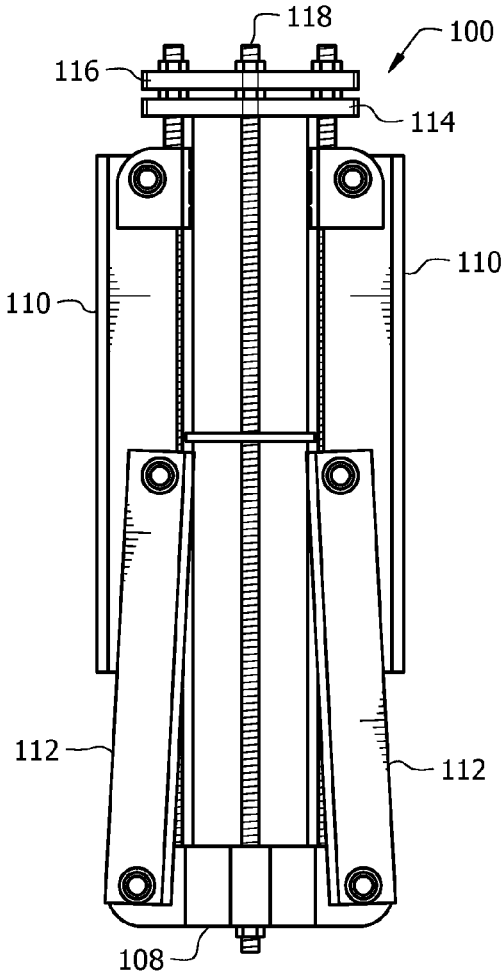
FIG. 3 is a side view of the interior underpin bracket of FIGS. 1 & 2 in a retracted position.
Figure 4:
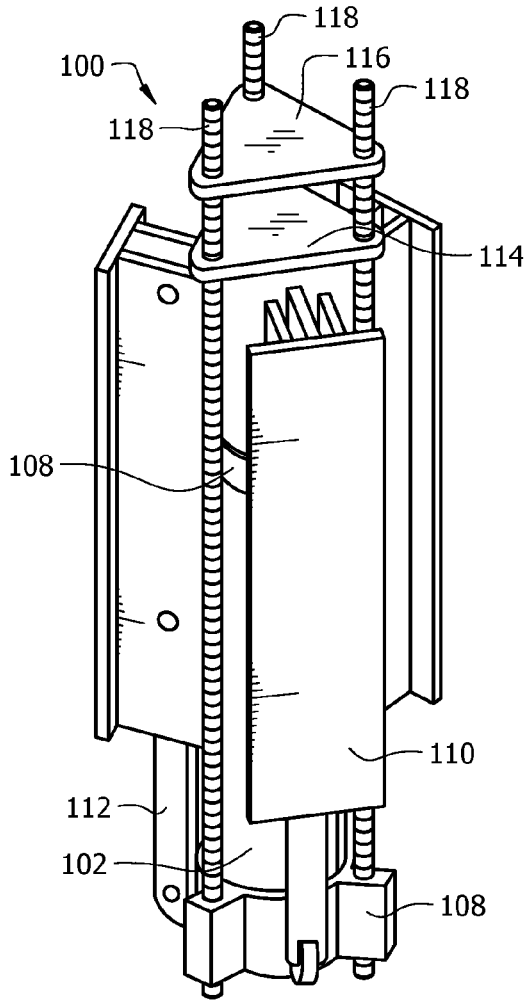
FIG. 4 is a perspective view of the interior underpin bracket of FIG. 3 in the retracted position.
Figure 5:
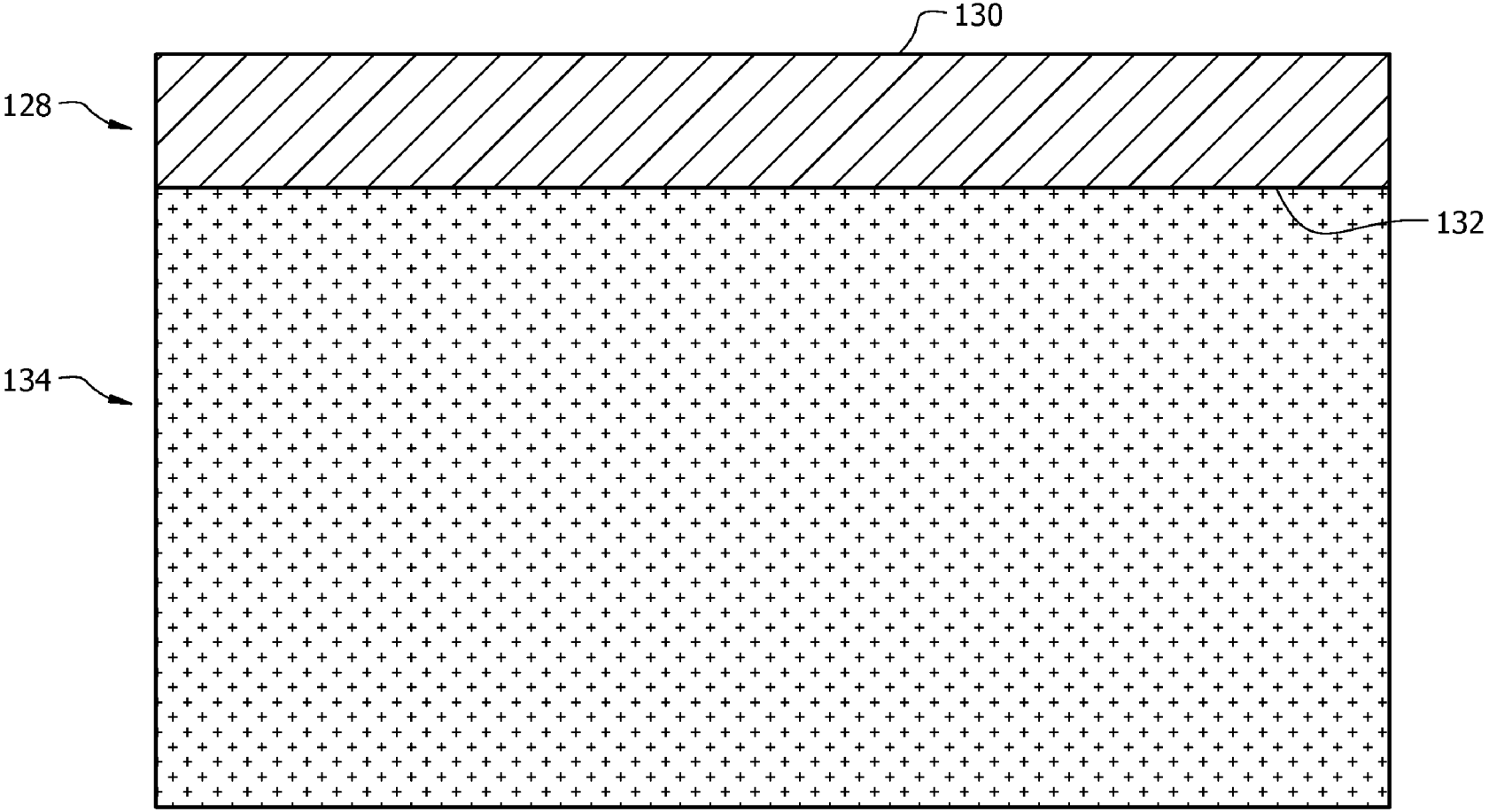
FIGS. 5-9 illustrate an embodiment of a method for installing an interior underpin bracket underneath the interior of a cast-in-place slab.

FIGS. 1-4 illustrate an embodiment of an interior underpin bracket 100. FIGS. 1 & 2 illustrate the interior underpin bracket 100 in an extended position (i.e., pivot support arms 110 in an extended position perpendicular to a support body or shaft 102). FIGS. 3 & 4 illustrate the interior underpin bracket 100 in a retracted position (i.e., the pivot support arms 110 in a retracted position alongside the shaft 102).

As best illustrated in FIGS. 1 & 2, the interior underpin bracket 100 comprises a support shaft 102 comprising a cylindrical body having a bottom end 104 and a top end 106. The shaft 102 defines a cylindrical bore through which the interior underpin bracket 100 may be installed over an underpinning pipe (e.g., a helical underpin). It should be appreciated that the size and dimensions of the interior underpin bracket 100 may vary depending on the particular application and the size and dimensions of the underpinning pipe. The interior underpin bracket 100 comprises a suitable structure and mechanism for pivotally attaching the support arms 110 to the shaft 102 and enabling the support arms 110 to be positioned between the retracted position and the extended position. Two or more support arms 110 may be implemented, although in one embodiment, three evenly-spaced arms are pivotally attached to the shaft 110. This configuration enables the interior underpin bracket 100 to provide uniform subsurface support when in the extended position. It should be appreciated that this may also provide a significant cost reduction because the drill holes may be spaced a greater distance apart, thereby decreasing the number of brackets needed per unit area.

The pivoting arrangement may be provided by pivotally fixing one end portion of a support arm 110 to the outer surface of the shaft 102. At another location on the support arm 110 (e.g., closer to the other end of the support arm 110), one end of a linkage member 112 may be pivotally fixed to the support arm 110. The other end of the linkage arm 112 may be pivotally fixed to an adjustable collar 108 that is adapted to adjustably slide along the shaft 102. From the extended position illustrated in FIGS. 1 & 2, as the adjustable collar 108 is moved toward the bottom end 104 of the shaft 102, the linkage arms 112 engage the support arms 110 from the extended position to the retracted position. One of ordinary skill in the art will appreciate that alternative pivoting mechanisms may be used to effectuate the extended and retracted positions.

The adjustable collar 108 may move relative to the shaft 102 via a support structure and mechanism that enables convenient user deployment between the retracted and extended positions and, additionally, provide a means for securing the interior underpin bracket 100 to the structure to be elevated, as well as a hydraulic jack. In one exemplary embodiment, the interior underpin bracket 100 comprises two adjustable plates (bottom plate support 114 and top plate support 116) and one or more rods (e.g., threaded rods 118). The threaded rods 118 are positioned alongside the shaft 102 with one end of a threaded rod 118 fixed to the adjustable collar 108, and another end extending above the top end 106 of the shaft 102. The bottom plate support 114 and the top plate support 116 may be adjustably positioned on the portion of the threaded rods 118 extending above the top end 106. As best illustrated in FIGS. 2 & 4, the threaded rods 118 may extend through holes in the plate supports 114 and 116. Accompanying fasteners 122 may be used to conveniently adjust the position of the plate supports 114 and 116 on the threaded rods 118 and relative to each other.

In the retracted position (FIGS. 3 & 4), the plate supports 114 may be positioned closer together to move the adjustable collar 108 toward the bottom end 104. From the retracted position, a user installing the interior underpin bracket 100 may grasp and lift the top support plate 116 against the fasteners 122, which lifts the adjustable collar 108. The movement of the adjustable collar 108 on the shaft 102 toward the top end 106 engages the linkage arms 112 and causes the support arms 110 to pivot and radially extend relative to the shaft 102. The adjustable collar 108 may engage with a collar stop 124 on the shaft 102 when the support arms 110 are fully extended in a perpendicular relationship with the shaft 102.

Having described the general components of the interior underpin bracket 100, an exemplary method for installing the device will be described with reference to FIGS. 5-9. The exemplary method involves installation of a plurality of brackets 100 underneath a cast-in-place slab 128 having an upper surface 130 and a lower surface 132. Underneath the cast-in-place slab is a subsurface material 134 comprising, for example, soil, limestone, other suitable support material, or any combination thereof. Each interior underpin bracket 100 may be installed in the manner described below.

Figure 6:
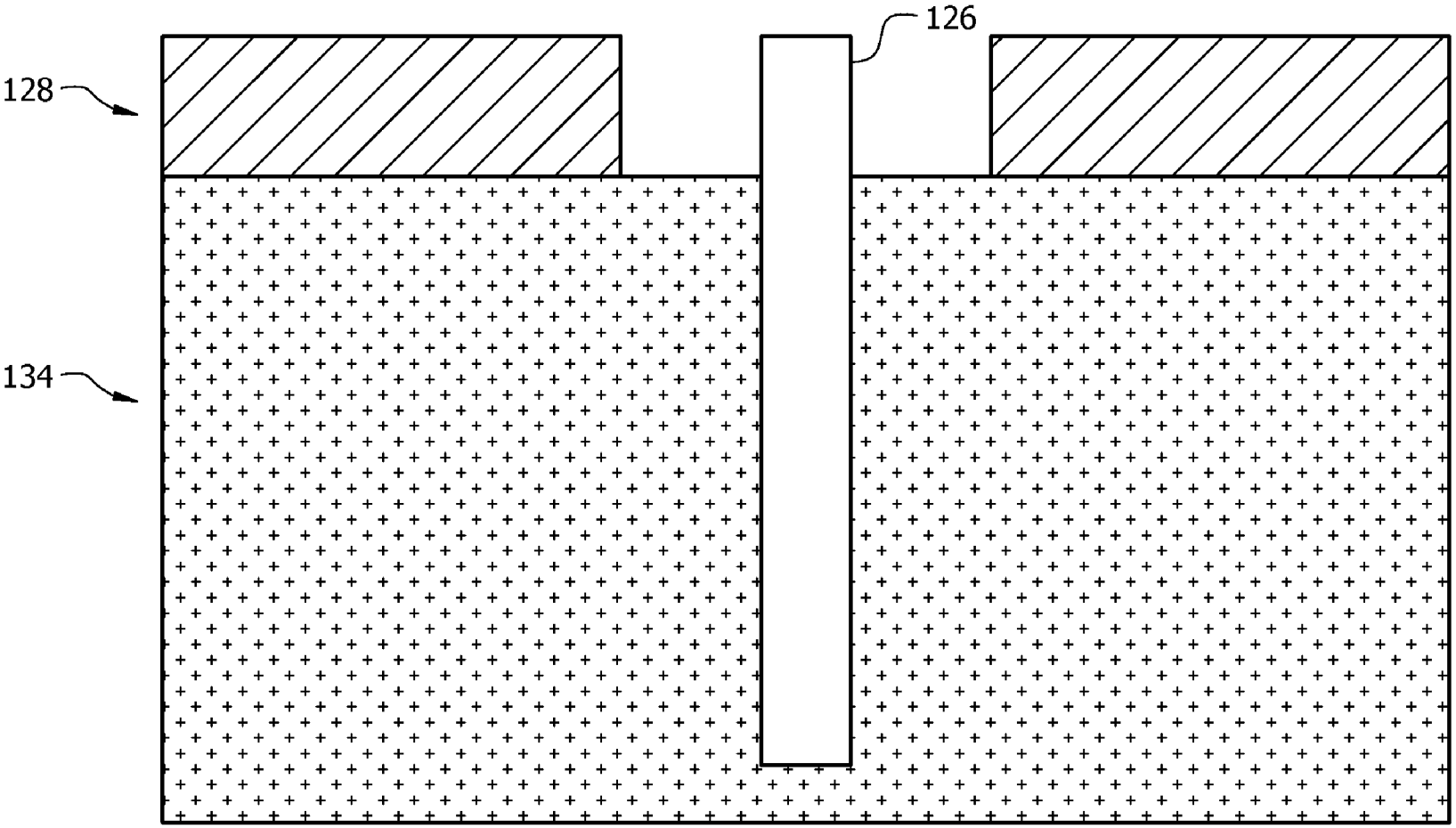

As illustrated in FIG. 6, at each installation location in the cast-in-place slab 128, a hole may be drilled to expose the subsurface material 134. An underpinning pipe 126 may be drilled into the subsurface material 134 until load-bearing conditions are met. It should be appreciated that the underpinning pipe 126 may comprise a series of connected pipes (e.g., helical pins) that are drilled or hydraulically advanced into the subsurface material 134 to a desired depth by, for example, a torque motor.

Figure 7:
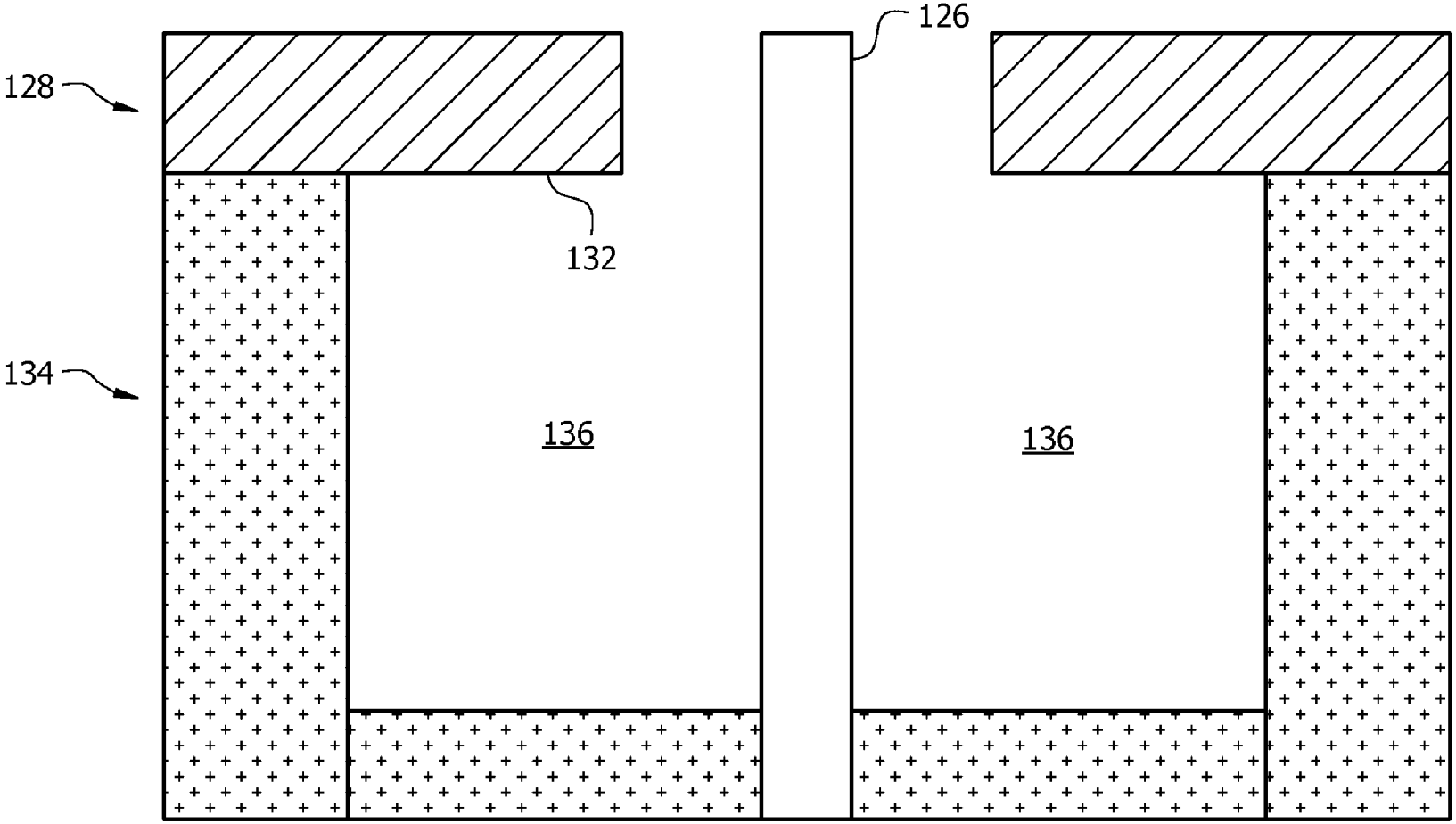
Figure 8:
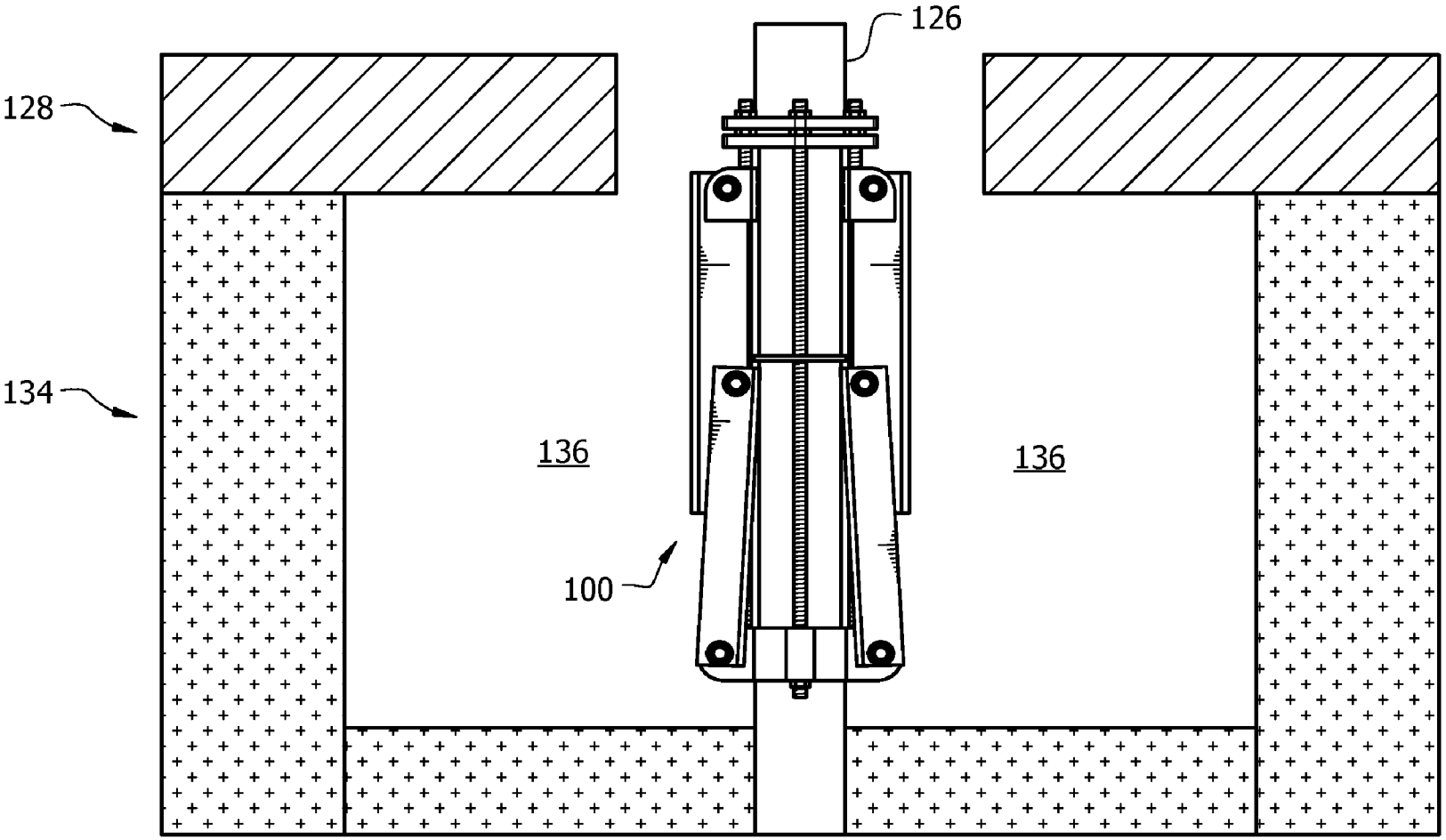
Figure 9:
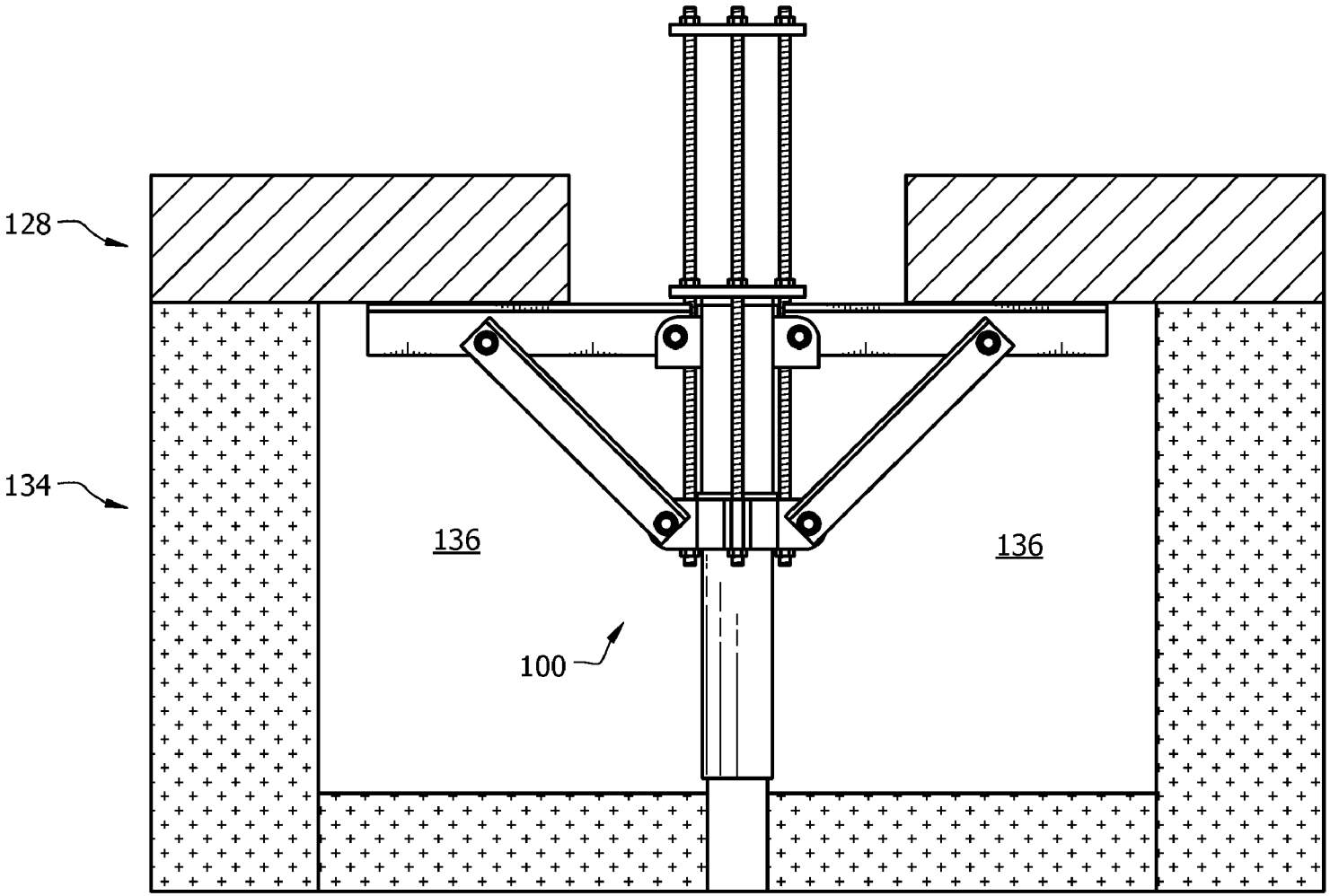

To facilitate the installation of the interior underpin bracket 100, a portion of the subsurface material 134 is excavated or otherwise removed to provide a void 136 in which the interior underpin bracket 100 may be placed (FIG. 7). As illustrated in FIG. 7, the shaft 102 of the interior underpin bracket 100 may be placed over the underpinning pipe 126 in the retracted position. In the manner described above, the support plates 116 and/or 114 may be grasped and lifted to extend the support arms 110 to the extended position. In this position, the support arms 110 may engage the lower surface 132 of the cast-in-place slab 128. The bottom support plate 114 may be adjusted on the threaded rods 118 to the position indicated in FIG. 9 and secured by the fasteners 122. The top plate support 116 may be secured on the threaded rods 118 (e.g., via fasteners 122) such that the plate supports 114 and 116 are separated by a predetermined distance for receiving a hydraulic ram or jack (or other mechanism for elevating the cast-in-place slab). The hydraulic ram may be placed between the plate supports 114 and 116. A hose may be connected between the hydraulic ram and a manifold, and a pump connected to the manifold. In operation, the pump applies hydraulic fluid pressure to the rams, which causes the ram to expand and apply pressure on the top support plate 116 and, thereby, lift the cast-in-place slab.

It should be noted that this disclosure has been presented with reference to one or more exemplary or described embodiments for the purpose of demonstrating the principles and concepts of the invention. The invention is not limited to these embodiments. As will be understood by persons skilled in the art, in view of the description provided herein, many variations may be made to the embodiments described herein and all such variations are within the scope of the invention.

What is claimed is:

1. An interior underpin bracket comprising:

a support shaft having a bore adapted to receive an underpin pipe; and at least two support arms pivotally fixed to the support shaft, the support arms adjustable between a refracted position in which the support arms are disposed parallel to the support shaft and an extended position in which the support arms are fixedly disposed perpendicular to the support shaft to engage an underside of a slab and provide subsurface support.

2. The interior underpin bracket of claim 1, further comprising an adjustable collar disposed on the support shaft and pivotally fixed to the supports arms.

3. The interior underpin bracket of claim 2, wherein the adjustable collar is positionable between a first position and a second position on the support shaft, wherein the supports arms are in the refracted position when the adjustable collar is at the first position and in the extended position when the adjustable collar is at the second position.

4. The interior underpin bracket of claim 3, further comprising at least two linkage arms for pivotally connecting the supports arms to the adjustable collar.

5. The interior underpin bracket of claim 2, further comprising a support rod disposed at least partially along the support shaft, the adjustable collar fixed to one end of the support rod, and the other end of the support rod extending beyond the support shaft.

6. The interior underpin bracket of claim 5, further comprising:

a first support plate adjustably fixed to the support rod; and a second support plate adjustably fixed to the support rod.

7. The interior underpin bracket of claim 6, wherein the first and second support plates are adapted to be fixed to the support rod a distance apart from each other to receive a hydraulic ram.

8. A subsurface support apparatus for elevating a structure, the subsurface support apparatus comprising:

a support shaft having a first open end, a second open end, and a bore for receiving an underpin pipe;

at least two retractable support arms pivotally fixed to the support shaft near the first open end; and an adjustable collar disposed on the support shaft between the retractable support arms and the second open end and pivotally attached to the retractable support arms, the adjustable collar being adjustable on the support shaft to pivot the support arms between a retracted position and a fixed extended position with the retractable support arms generally perpendicular to the support shaft to provide uniform subsurface support to an underside of a structure to be elevated.

9. The subsurface support apparatus of claim 8, wherein the support arms are pivotally fixed to the adjustable collar via respective linkage members.

10. The subsurface support apparatus of claim 8, further comprising a support rod fixed to the adjustable collar and extending along the support shaft.

11. The subsurface support apparatus of claim 10, wherein the support rod extends above the first open end when the support arms are in the fixed extended position.

12. The subsurface support apparatus of claim 11, further comprising a pair of adjustable support plates fixed to the support rod.

13. The subsurface support apparatus of claim 12, wherein the adjustable support plates are adapted to be fixed to the support rod a distance apart from each other to receive a hydraulic ram.

14. The subsurface support apparatus of claim 8, wherein the support shaft comprises a stop collar configured to fix the support arms in the extended position.

15. The subsurface support apparatus of claim 14, wherein the stop collar comprises a stop collar ring.

16. A method for elevating a cast-in-place slab, the method comprising:

drilling a hole in a cast-in-place slab;

installing an underpin pipe in a subsurface material underneath the cast-in-place slab;

removing the subsurface material around the hole;

installing a bracket having retractable support arms on the underpin pipe with the retractable support arms in a refracted position;

extending the retractable support arms; and fixing the retractable support arms in an extended position to provide support to the cast-in-place slab.

17. The method of claim 16, wherein the underpin pipe comprises one of a helical underpin or a hydraulically advanced underpin.

18. The method of claim 16, further comprising:

fixing the bracket to the cast-in-place slab;

fixing a hydraulic ram to the bracket; and raising the bracket.

* * * * *